United States Patent [19]

Erickson

[11] Patent Number: 4,674,950

[45] Date of Patent: Jun. 23, 1987

[54] PITOT TUBE FOR PITOT TYPE CENTRIFUGAL PUMP

[75] Inventor: John W. Erickson, Huntington Beach, Calif.

[73] Assignee: Dresser Industries, Inc., Dallas, Tex.

[21] Appl. No.: 796,819

[22] Filed: Nov. 12, 1985

[51] Int. Cl.[4] ..... F04D 1/12

[52] U.S. Cl. ..... 415/88; 415/80

[58] Field of Search ..... 415/88, 89, 80, 143, 415/6, 168, 63, 81

[56] References Cited

U.S. PATENT DOCUMENTS

| | | | |
|---|---|---|---|
| 3,671,136 | 6/1972 | O'Mara et al. | 415/89 |
| 3,977,810 | 8/1976 | Erickson et al. | 415/89 |
| 4,209,080 | 6/1980 | Douglas | 415/88 |
| 4,322,199 | 3/1982 | Erickson | 415/88 |

FOREIGN PATENT DOCUMENTS

| | | | |
|---|---|---|---|
| 633236 | 1/1928 | France | 415/80 |
| 2252029 | 1/1973 | France | 415/88 |
| 1432 | of 1784 | United Kingdom | 415/80 |
| 5010 | of 1838 | United Kingdom | 415/80 |
| 853174 | 8/1981 | U.S.S.R. | 415/89 |

*Primary Examiner*—Robert E. Garrett

*Assistant Examiner*—John Kwon

[57] ABSTRACT

The improved pitot tube is useful in pitot type centrifugal pumps and is located within a rotor in the pump. The pitot tube projects radially from the axial center line of the pump and has an entry adjacent to the inside of the wall of the rotor. The entry is oriented circumferentially to receive fluid energized by the rotor. The pitot tube has a passageway therethrough which extends from the entry to an outlet located on the axial center line of the pump. Between the entry and outlet there is provided an entry transition portion that is curved to change the direction of flow from centrifugal to radial, a radial portion, and an outlet transition portion that is curved to change the direction of flow through the passageway from radial to axial. Located in the passageway are one or more ribs or vanes which are curved through the entry transition portion of the passageway and extend into the outlet thereof. The ribs provide for streamlining the flow to avoid turbulence to decrease the internal drag in the passageway and also to reinforce the pitot tube so that the walls thereof may be made substantially thinner whereby outside width of the tube can be decreased to reduce the external drag loss.

6 Claims, 15 Drawing Figures

PITOT TUBE FOR PITOT TYPE CENTRIFUGAL PUMP

BACKGROUND OF THE INVENTION

This invention relates generally to pitot type centrifugal pumps. More particularly, this invention relates to an improved pitot tube having a rib or guide vane therein extending from the inlet to the outlet of the pitot tube.

Centrifugal pumps of the pitot type are well known and are illustrated by U.S. Pat. No. 3,776,658 issued Dec. 4, 1973, to John W. Erickson and by U.S. Pat. No. 3,999,881 issued Dec. 28, 1976, to Walter W. Crichlow.

Particular reference is made to the Erickson patent which, in FIG. 2, illustrates a rib or flow vane that is located in the pitot tube. However, it will be noted that the rib illustrated therein extends from a radial portion of the pitot tube into the outlet thereof.

In such pumps, problems have been encountered with the loss in pump efficiency caused by the external drag due to fluid passing over the exterior of the pitot tube and due to pressure loss as a result of internal drag as fluid flows through the interior of the pitot tube. In attemping to alleviate the external drag loss, which is maximum at the inlet portion of the pitot tube, the exterior configuration of the pitot tube has been designed as an airfoil with the tube being reduced to its minimum width or chord as compared to its thickness. In an effort to alleviate the internal drag loss, flow directing ribs or vanes illustrated in the Erickson patent have been utilized.

An object of the invention is to provide an improved pitot tube that reduces both external and internal drag and thereby improves the efficiency of a pitot type centrifugal pump in which the improved pitot tube is used.

SUMMARY OF THE INVENTION

This invention provides an improvement in centrifugal pumps of the pitot type, the pump having a housing, a rotor axially journaled in the housing for imparting energy to a fluid in response to rotation of a prime mover, means for supplying fluid to the rotor, and a pitot tube in the rotor having a passageway for receiving energized fluid from the rotor and discharging the fluid from the pump. The improved pitot tube includes: an entry portion of the passageway disposed adjacent to the interior of a wall forming the outer periphery of the rotor and oriented in a circumferential direction for receiving the energized fluid; a radial portion of the passageway having a first end and a second end; an outlet portion of the passageway extending along the rotor axis for discharging the fluid from the pump; and an entry transition portion of the passageway connecting the entry portion to one end of the radial portion. The entry transition portion is curved to change the fluid flow direction from circumferential to radial. The tube also has an outlet transition portion of the passageway that connects the radial portion of the passageway to the outlet portion. The outlet transition portion is gradually curved to change the fluid flow direction from radial to axial. A rib extends across the passageway generally perpendicularly to the inlet. The rib has: an inlet end portion curved to fit the entry transition portion of the passageway and extends through the entry transition portion, an intermediate portion disposed in the radial portion of the passageway, and an outlet end portion extending from the intermediate portion through the outlet transition portion of the passageway.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
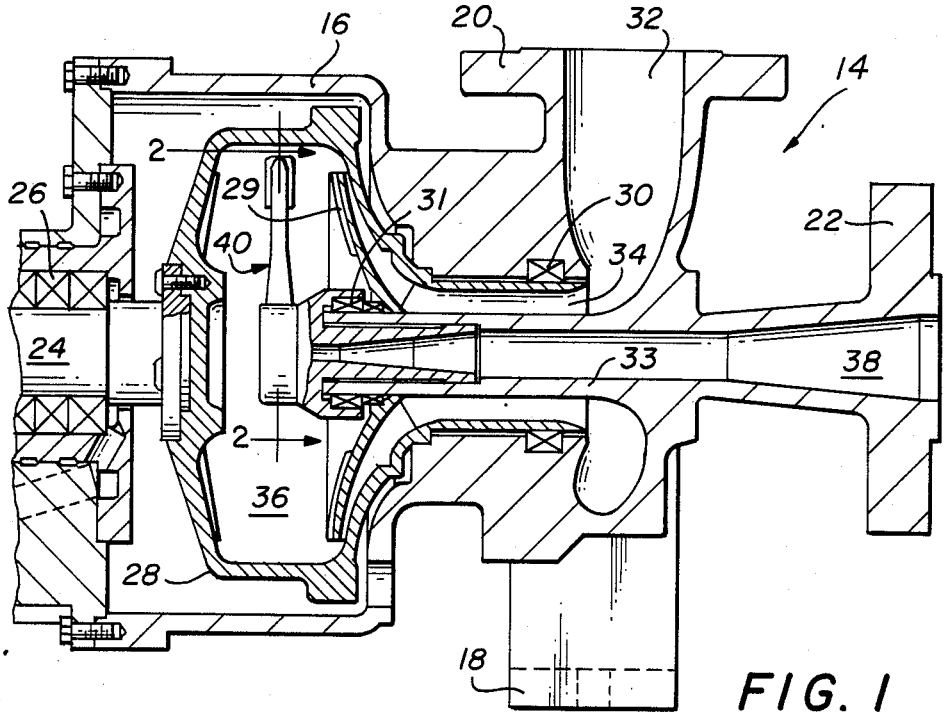
FIG. 1 is a simplified, vertical cross section of a pitot type centrifugal pump incorporating a pitot tube that is constructed in accordance with the invention.

Referring to the drawing and to FIG. 1 in particular, shown therein and generally designated by the reference character 14 is a pitot type centrifugal pump. The pump 14 includes a housing 16 having a mounting base or leg 18, an inlet 20, an outlet bell 22, and an input shaft 24. The input shaft 24 is journaled in the housing 16 by thrust and radial bearings 26 and has one end connected to a prime mover (not shown).

The opposite end of the shaft 24 is connected to a rotor 28 which is cantilever supported by the bearings 26 and sealed with respect to the housing 16 by spaced seals 30 and 31. The rotor 28 includes an impeller portion 29 which rotates therewith and whose blades add rotational energy to the fluid before entering the rotor 28. The inlet 20 includes an inlet passageway 32 that is connected to an annular passageway 34 which connects to the inlet of impeller 29. The outlet of the impeller 29 enters the interior 36 of rotor 28.

The outlet 22 includes an outlet passageway 38 that extends concentrically through the passageway 34 to a pitot tube 40. The pitot tube 40 is held stationary in the interior 36 of the rotor 28 by support tube 33.

FIGS. 2–12 illustrate in detail the structure of the pitot tube 40. The pitot tube 40 includes a passageway 42 that extends therethrough from an entry end 44 to an outlet portion 46 (see FIG. 3). As can be appreciated by viewing FIGS. 1, 2, 3, the pitot tube 40 extends radially from the axis of rotation of the pump 14 so that the entry end 44 is disposed adjacent to the inside of the wall of the rotor 28 and is oriented in a circumferential direction appropriate to receive fluid located in the interior 36 of the rotor 28. The fluid is energized or caused to rotate in the interior 36 by the rotation of the rotor 28 and impeller 29 which are driven by the prime mover (not shown). The passageway 42 includes a radial portion 48 that extends between the entry end 44 and the outlet portion 46. At one end of the radial portion 48, the passageway 42 is connected to the entry end 44 by an entry transition portion 50. The entry transition portion is curved to change the direction of fluid flowing through the passageway 42 from circumferential to radial. At the other end, the radial portion 48 is connected to the outlet portion 46 by an outlet transition portion 52 which is curved to change the direction of fluid flowing therethrough from the radial direction to an axial direction for discharge from the pump 14 through the outlet 38.

Disposed within the passageway 42 of the pitot tube 40 is a rib 54 that extends across the passageway 42 from one side to the other of the pitot tube 40 generally perpendicularly to the entry end 44. As may be most clearly seen in FIG. 2, the rib 54 includes an entry end portion 56 that is located at entry end 44 and is curved to fit the entry transition portion 50 of the passageway 42 and extends therethrough. The rib 54 also includes a radial portion 58 that extends through the radial portion 48 of the passageway 42 in the pitot tube 40. As may be seen more clearly in FIG. 3, the rib 54 also includes an outlet end portion 60 that has been shaped to extend through the outlet transition portion 52 of the passageway 42.

Figure 2:
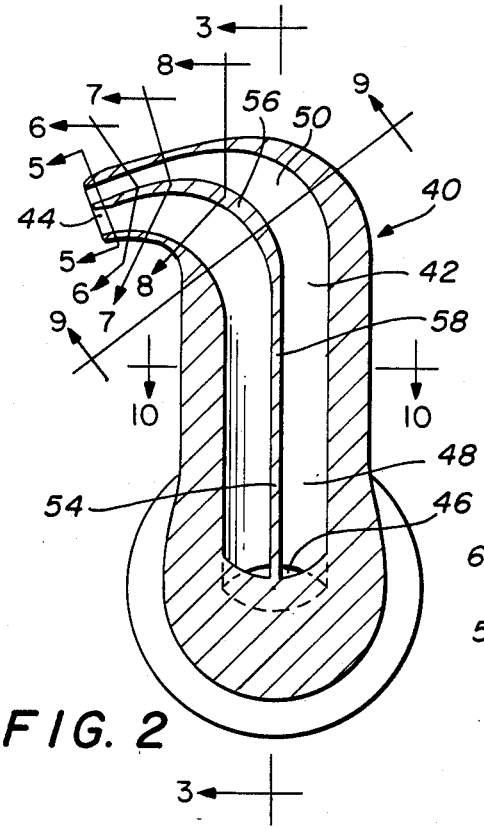
FIG. 2 is an enlarged cross sectional view of the pitot tube of the pump in FIG. 1 taken generally along the line 2—2 of FIG. 1.

As shown in FIG. 2, the rib 54 starts very thin near the entry end 44 of the passageway 42, thickens in the entry transition portion 50 of the passageway 42 and then becomes relatively thin as the rib 54 enters the radial portion 48 of the passageway 42. The inlet transition portion 56 of the rib 54 is thus of a general airfoil configuration. The shape provides streamlining of the fluid flow as it passes through the entry transition portion 50 of the passageway 42. The efficiency of the pump 14 is increased due to the streamlining of the fluid flow and by the avoidance or reduction of turbulence loss within the passageway 42.

Figure 3:
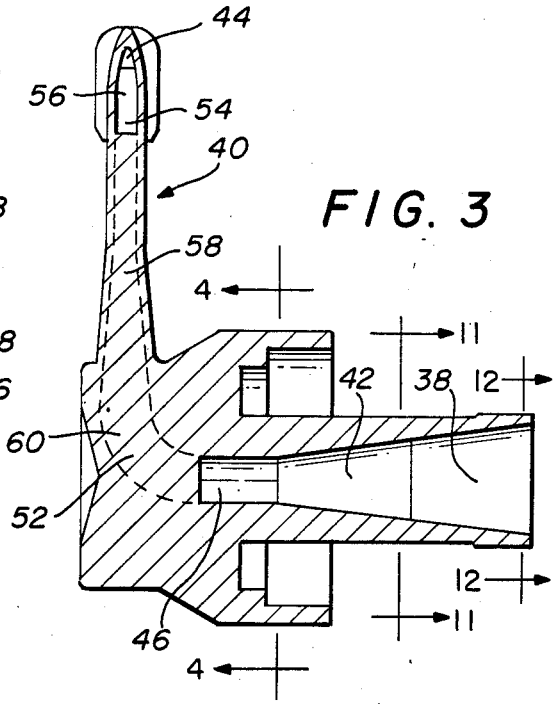
FIG. 3 is a sectional view of the pitot tube of FIG. 2 taken generally along the line 3—3 of FIG. 2.
Figure 4:
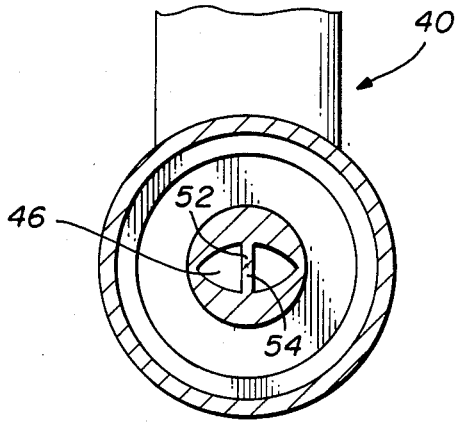
FIG. 4 is a fragmentary cross sectional view taken generally along the line 4—4 of FIG. 3.
Figure 5:
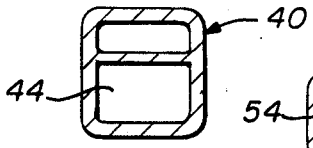
FIG. 5 is an enlarged, transverse cross sectional view taken generally along the line 5—5 of FIG. 2.
Figure 6:
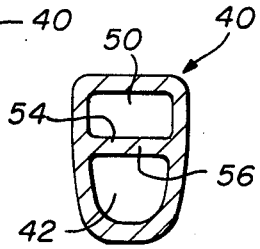
FIG. 6 is an enlarged, transverse cross sectional view taken generally along the line 6—6 of FIG. 2.
Figure 7:
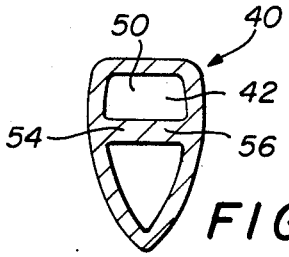
FIG. 7 is an enlarged, transverse cross sectional view taken generally along the line 7—7 of FIG. 2.
Figure 8:
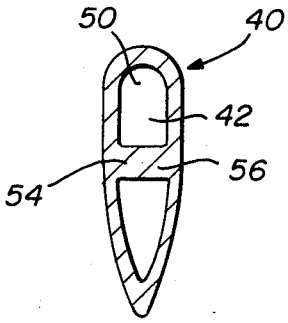
FIG. 8 is an enlarged, transverse cross sectional view taken generally along the line 8—8 of FIG. 2.

FIGS. 5–12 are taken at various section lines of FIGS. 2 and 3 to illustrate the shape of the passageway 42 at various points along the pitot tube 40. FIG. 5 is taken at the entry portion 44 of the passageway 42 and does not show the rib 54. FIGS. 6, 7, 8 and 9 are taken along the entry transition portion 50 of the passageway 42 and thereby illustrate the airfoil configuration of the inlet transition portion 56 of the rib 54.

Figure 9:
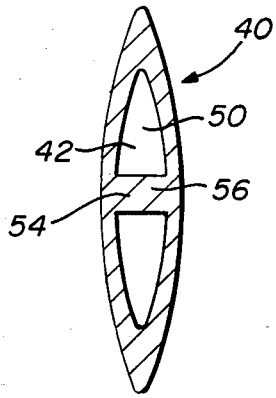
FIG. 9 is an enlarged, transverse cross sectional view taken generally along the line 9—9 of FIG. 2.
Figure 10:
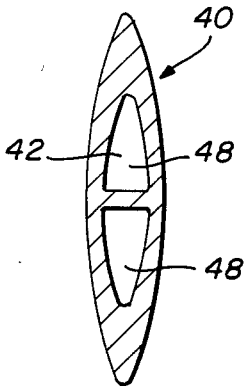
FIG. 10 is an enlarged, transverse cross sectional view take along the line 10—10 of FIG. 2.

FIG. 10 is taken at the approximate juncture between the entry transition portion 50 of the passageway 42 and the radial portion 48 of the passageway 42. FIGS. 9 and 10, in particular, clearly show the ratio between the thickness and chord of the airfoil configuration of the radial portion of the pitot tube 40.

Figure 11:
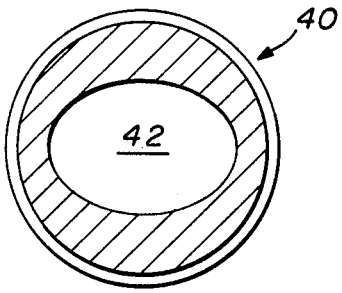
FIG. 11 is an enlarged, transverse cross sectional view taken generally along the line 11—11 of FIG. 3.
Figure 12:
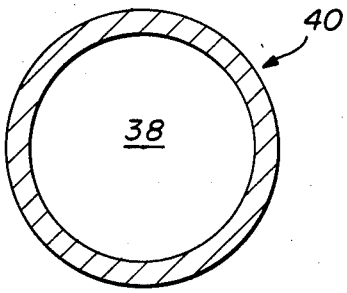
FIG. 12 an enlarged, transverse cross sectional view taken generally along the line 12—12 of FIG. 3.

FIGS. 11 and 12 are transverse cross sections of FIG. 3 which illustrate the transition of the configuration of the outlet portion 46 of the passageway 42 into the pump outlet 38.

Operation of the Preferred Embodiment

With the shaft 24 of the pump 14 being driven by the prime mover (not shown), the connected rotor 28 rotates within the bearings 26 and relative to the housing 16. Fluid enters the inlet 32 of the pump 14 and flows through the passageway 34, past the impeller 29 and into the interior 36 of the rotor 28. The rotation of the rotor 28 and impeller 29 causes the fluid to be rotated therein in the appropriate direction to enter the entry end 44 of the passageway 42 in the pitot tube 40 encountering the rib 54. The fluid passes into the transition portion 50 where the flow is streamlined by the inlet transition portion 56 of the rib 54. The radial portion 58 and the outlet end portion 60 of the rib 54 maintain the streamline flow until the fluid flows from the pitot tube 40 into the pump outlet 38.

The provision of the rib 54 extending through the pitot tube 40 not only provides for the streamlining of flow through the passageway 42, but also strengthens and stiffens the pitot tube 40, particularly in the region of greatest potential external loss, that is, in the entry transition portion. Approximately 75% of the external drag occurs on this portion of the pitot tube. The rib 54 permits the thickness of the tube wall to be substantially reduced, reducing the overall thickness and chord of the pitot tube 40. Thus, the tube 40 can have a smaller entry and entry transition external size for a predetermined flow area through the pitot tube 40. This provides an increase in the efficiency of the pump 14 by reducing the external drag on the pitot tube.

The use of the entry transition 56 of the rib 54 halves the relative sharpness of the entry transition turn resulting in higher pump efficiency by reducing the turn total pressure loss. The two main sources of inefficiency in the pitot pump are the drag losses on the external surface of the pitot tube as the rotating fluid in the rotor passes by the tube and the total pressure losses inside the pitot tube as the discharge flow of the pump is brought out of the pump. As the flow pattern inside the rotor is a forced vortex, the drag loss velocity energy on the external surface increases with the square of the radius. Therefore, the outer radial $\frac{1}{3}$ of the tubes external surface, the head, produces over $\frac{3}{4}$ of the external tube drag. To minimize the head external drag the outer surface of it is made as an airfoil. The drag of the airfoil shaped head is minimized in three ways, first, the airfoil section utilized has the smallest chord length possible by increasing the airfoil thickness until just before flow separation occurs on the surface. Secondly, the internal flow area is held constant in the head region to minimize head size for a given pump flow. Thirdly, the tube walls are made thin by providing intermittent supports between opposite walls reducing the wall bending stress caused by internal tube pressure. The rib in the entry transition portion of the tube decreases the internal loss in the tube by about 10%. The smaller external pitot tube size, which results from the support provided by the rib, results in a reduction in external drag loss of 30%. Pump tests have agreed with these theoretical predictions showing an increase in pump efficiency of about 15% when the tube was constructed in accordance with the invention. In some instances it may be more efficient to have more than one rib side by side.

Figure 13:
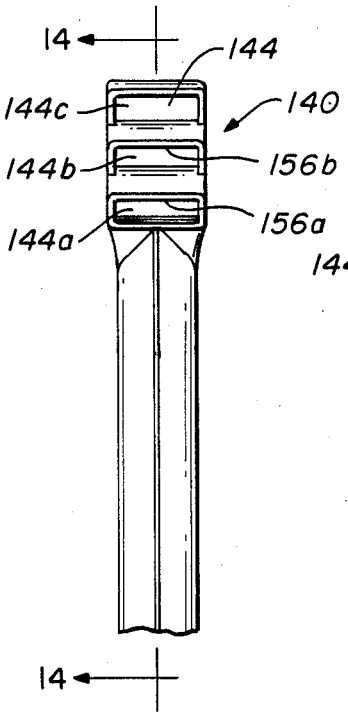
FIG. 13 is a partial front elevation of a modified pitot tube that is also constructed in accordance with the invention.
Figure 14:
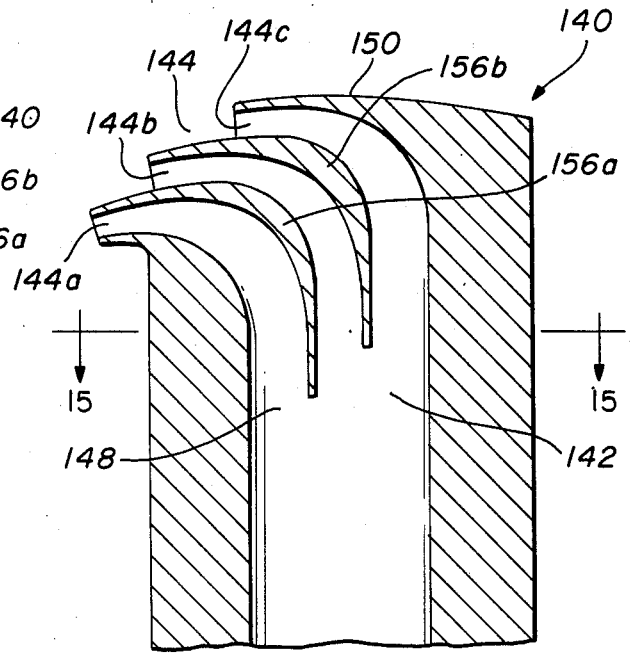
FIG. 14 is a cross sectional view of the pitot tube of FIG. 13 taken generally along the line 14—14 of FIG. 13.
Figure 15:
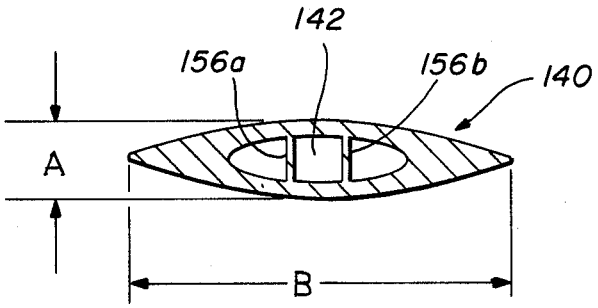
FIG. 15 is a transverse cross sectional view taken along the line 15—15 of FIG. 4.

FIGS. 13, 14 and 15 illustrate a modification of a pitot tube that can be utilized in the pitot pump of this invention. The modified pitot tube is designated by the reference character 140 and includes a flow passageway 142 that extends therethrough from an entry end 144 to an outlet end or portion (not shown) such as the outlet 46 of FIGS. 2 and 3. The entry end 144 is connected to a radial portion 148 of the passageway 142 by a curved transition portion 150.

As illustrated in FIGS. 13 and 14, the entry end 144 has been divided into three portions 144*a*, 144*b* and 144*c* by a pair of curved ribs 156*a* and 156*b* which serve to change the direction of fluid entering the entry end 144 from circumferential to radial as it enters the radial portion 140 of the passageway 142. The ribs 156*a* and 156*b* serve the same purpose as did the rib 56 of the pitot tube 40.

The airfoil configuration of the pitot tube 140 is clearly illustrated in FIG. 15. As shown therein, the pitot tube 140 includes a thickness B and a chord A with the cross-sectional configuration diminishing toward each end providing a streamlined frontal surface to the flow of fluid thereby and thus reducing the drag of the pitot tube 140.

From the foregoing detailed description, it will be appreciated that a pitot type centrifugal pump, when utilizing a pitot tube constructed in accordance with the invention will be more efficient as compared to previously known pumps due to: (1) the reduction in interior drag loss as a result of streamlining the flow in the entry transition portion and decreasing the total pressure loss drop therethrough, and (2) the reduction in exterior drag loss resulting from a smaller external surface area of the tube 40 as a result of the strength and stiffness provided by the addition of one or more ribs in the critical entry end 44 and entry transition portion 50 of the pitot tube 40.

The invention has been described in detail hereinbefore and it will be appreciated that many changes and modifications can be made thereto without departing from the spirit or scope of the invention.

What is claimed is:

1. An improved pitot tube for a centrifugal pump of the pitot type, the pump having a housing, a generally cylindrical rotor journaled in the housing for imparting centrifugal energy to a fluid in response to a prime mover, means for supplying fluid to the rotor, said improved pitot tube comprising:

a hollow pitot tube body having a discharge end portions mounted in said housing and oriented axially with respect to said rotor, said body defining an inlet adjacent to the interior of the rotor and oriented in a circumferential direction for receiving said energized fluid, an intermediate portion extending generally radially between said discharge end portion and a curved inlet transition portion immediately following said inlet, said intermediate portion includes a curved outlet transistion portion immediately preceding said discharge end portion;

at least one rib located in said tube body and extending therein from said discharge end portion through said intermediate portion, said inlet and through both transition portions;

said intermediate portion of said pitot tube body having substantially less overall width in the axial direction than in the circumferential direction; and, said rib extending generally axially across said tube body for supporting said pitot tube body said inlet and said inlet transition portion sized for a predetermined flow area and a minimum wall thickness as strengthened by said rib providing minimum external drag to said energized fluid in the said rotor and minimum resistance to internal flow through said tube.

2. The improvement of claim 1 and including a plurality of said ribs spaced to divide said passageway throughout a portion of its length.

3. The improvement of claim 1 and including a plurality of said ribs spaced to divide said passageway throughout a portion of its length.

4. An improved pitot tube for a centrifugal pump of the pitot type, the pump having a housing, a generally cylindrical rotor journaled in the housing for imparting centrifugal energy to a fluid in response to a prime mover, means for supplying fluid to the rotor, said improved pitot tube comprising:

a hollow pitot tube body having a discharge end portion mounted in said housing and oriented axially with respect to said rotor, an inlet end portion disposed adjacent to the interior of the rotor and oriented in a circumferential direction for receiving said energized fluid, and an intermediate portion extending radially between said end portions, said inlet end portion including an inlet facing opposite the direction of rotation of said housing and a curved entry transition portion connecting said inlet end portion to said intermediate portion;

at leat one rib located in said tube body and extending generally through the center of said tube from adjacent said inlet through said curved entry transition portion, said rib joining axially spaced walls of said pitot tube for structurally strengthening said walls; and, wherein said walls are a minimum thickness coextensive with said rib to withstand pressure developed in said tube body with said walls defining a flow passageway therethrough sized to provide minimum resistence to internal flow therethrough while having an exterior sized to minimize external drag losses as said fluid flows past said pitot tube body.

5. The pitot tube of claim 4 wherein said tube body defines an axial thickness that is substantially smaller than the chord in the circumferential direction.

6. The pitot tube of claim 5 wherein said rib extends from said entry to an outlet in said discharge end portion.

* * * * *